US007483022B2

(12) United States Patent
Edwards

(10) Patent No.: US 7,483,022 B2
(45) Date of Patent: Jan. 27, 2009

(54) ACTIVE MATRIX DISPLAYS AND DRIVE CONTROL METHODS

(75) Inventor: Martin J. Edwards, Crawley (GB)

(73) Assignee: Chi Mei Optoelectronics Corporation, Tainan (TW)

( * ) Notice: Subject to any disclaimer, the term of this patent is extended or adjusted under 35 U.S.C. 154(b) by 501 days.

(21) Appl. No.: 10/550,053

(22) PCT Filed: Mar. 16, 2004

(86) PCT No.: PCT/IB2004/000857

§ 371 (c)(1),
(2), (4) Date: Sep. 20, 2005

(87) PCT Pub. No.: WO2004/086339

PCT Pub. Date: Oct. 7, 2004

(65) Prior Publication Data

US 2006/0267896 A1 Nov. 30, 2006

(30) Foreign Application Priority Data

Mar. 27, 2003 (GB) ..... 0307034.9

(51) Int. Cl.
*G09G 5/00* (2006.01)

(52) U.S. Cl. ..... 345/208; 345/87; 345/94; 345/204

(58) Field of Classification Search ..... 345/55, 345/87, 94, 95, 96, 204, 205, 206, 208, 209, 345/210

See application file for complete search history.

(56) References Cited

U.S. PATENT DOCUMENTS

| | | | | |
|---|---|---|---|---|
| 5,923,310 | A * | 7/1999 | Kim | 345/90 |
| 6,229,506 | B1 * | 5/2001 | Dawson et al. | 345/82 |
| 6,498,595 | B1 * | 12/2002 | Knapp et al. | 345/94 |
| 7,079,102 | B2 * | 7/2006 | Miyachi | 345/94 |
| 2002/0154104 | A1 | 10/2002 | Inoue et al. | |

FOREIGN PATENT DOCUMENTS

WO WO 2004/015668 2/2004

* cited by examiner

*Primary Examiner*—My-Chau T Tran
(74) *Attorney, Agent, or Firm*—Fish & Richardson P.C.

(57) ABSTRACT

A method of controlling an active matrix LCD involves providing a pixel drive signal to each pixel for storage on the pixel for a first period of time and providing a second drive voltage to each pixel for a second period of time, wherein the durations of the first and second periods of time are controlled to vary the pixel light output. In this method, each pixel is driven in two stages. For the first stage, the pixel data voltages remain constant, and in the second stage a different voltage is applied to the pixels. The light output from the pixels is modified by altering the durations of the two stages. This avoids the need for additional adjustable voltage sources to enable compensation for temperature and other conditions.

27 Claims, 13 Drawing Sheets

ACTIVE MATRIX DISPLAYS AND DRIVE CONTROL METHODS

This invention relates to active matrix display devices, and particularly to the control of the drive voltages applied to the display pixels.

Active matrix liquid crystal displays (AMLCDs) are one well known example of active matrix display. In such displays, an active plate and a passive plate sandwich a liquid crystal. The active plate includes a number of electrodes for applying electric fields to the liquid crystal and the electrodes are generally arranged in an array. Row and column electrodes extending along the rows and columns of pixel electrodes connect and drive thin film transistors which drive respective pixel electrodes.

The row and column electrodes are driven to control the thin film transistors to control the charge stored on corresponding pixel electrodes. Each pixel may also include a capacitor for maintaining charge on the pixel.

One difficulty is in providing the necessary circuits for decoding incoming signals and driving the row and column electrodes. Generally, such driver circuits are arranged around the outside the pixel array.

There is currently much interest in the use of low temperature polysilicon (LTPS) to integrate some of the functions of a driver IC onto the glass of an AMLCD. Integration helps save some of the IC cost and can also make the display more compact. For example, one of the functions which it is desirable to integrate is the digital to analogue converters (DACs) used to convert digital input data into the analogue drive voltages required to fix the transmission of an LC pixel.

It has been proposed to provide a control scheme for adjusting the drive voltages applied to the display pixels in response to control parameters. For example, many commonly available LCD devices exhibit poor or limited contrast characteristics when subject to high ambient temperatures. The contrast ratio (luminance with all pixels white divided by luminance with all pixels black) of an LCD display indeed depends primarily on ambient temperature. Temperature compensation control systems have therefore been proposed.

One way to implement a control system is to adjust the analogue drive voltages applied to the liquid crystal pixels in the AMLCD. Although temperature variations are mentioned above, this control may be to allow the use of different liquid crystal materials or to compensate for variations in the electro-optical behaviour of the displays as a result of process variations. One approach is to control the mean and rms drive voltages experienced by the pixels of the display, by using adjustable voltage sources. For example, adjustable voltage sources may be used for the reference voltages supplied to the digital to analogue converter circuits.

It is currently difficult to integrate adjustable voltage sources which have the required performance in terms of output impedance, accuracy and power consumption using low temperature polysilicon (LTPS).

There is therefore a need for a control scheme which allows the display output characteristics to be varied but without requiring the use of adjustable voltage sources.

According to the invention, there is provided a method of controlling a display device comprising an array of display pixels, each pixel comprising a thin film transistor switching device and a display element, the array being arranged in rows and columns with each column of pixels sharing a column conductor to which pixel data voltages are provided, the method comprising, for each field period during which data is stored into the array of pixels:

providing a pixel drive signal to each pixel for storage on the pixel for a first period of time, the pixel drive signal comprising a selected one of a plurality of pixel drive levels;

providing a second drive voltage to each pixel for a second period of time, wherein the durations of the first and second periods of time are controlled to vary the pixel light output.

In this method, each pixel is driven in two stages. For the first stage, the pixel data voltages remain constant, and in the second stage a different voltage is applied to the pixels. The light output from the pixels is modified by altering the durations of the two stages. Thus, the invention involves modifying the voltage waveforms appearing across the liquid crystal pixels during the second stage, when in a conventional AMLCD the voltages would be held constant at the pixel drive level. The invention avoids the need for additional adjustable voltage sources. As a result, it becomes easier to produce a highly integrated display using TFT circuits. This invention may also offer power savings for displays using conventional crystalline silicon drive circuits by reducing the complexity of the analogue circuits required.

Preferably, the pixel drive signal is provided to each pixel by providing a first row pulse on a row conductor timed with the application of a pixel data voltage on the column conductor. Thus, the pixel drive signal is loaded into the pixel in conventional manner.

In one example, the second drive voltage is provided to each pixel by providing a second row pulse on a row conductor timed with the application of the second drive voltage on the column conductor. Thus, each row has two row pulses in each field period, one for loading the data and one for loading the second drive voltage. The durations of the first and second periods of time are then controlled by selecting the timing of the second row pulse relatively to the first row pulse.

Each pixel may be addressed with a first polarity in a first group of field periods and with a second opposite polarity in a second group of field periods. Thus, the invention can be used where inversion schemes are desired.

The second drive voltage may comprise a fixed reference drive voltage, and for inversion schemes, a first reference drive voltage can be provided for pixels driven to the first polarity and a second reference drive voltage can be provided for pixels driven to the second polarity. The first and second reference drive voltages can be of equal magnitude and opposite polarity.

The durations of the first and second periods of time are together substantially equal to the field period. Thus, the field period may be divided into only the two stages mentioned above.

Instead, the method may further comprise providing zero volts to each pixel for a third period of time. This provides additional freedom of control, and the durations of the first, second and third periods of time are then together substantially equal to the field period. Providing zero volts to each pixel may for example be achieved by discharging a pixel storage capacitor for the third time period.

In some examples, each pixel may comprise a pixel storage capacitor, and the step of providing a pixel drive signal to each pixel for storage on the pixel for a first period of time comprises applying a pixel data voltage to the column and forming the pixel drive signal by capacitive coupling using the pixel storage capacitor.

In this way, the invention can applied to drive schemes in which a part of the pixel voltage is provided by capacitive coupling of a voltage step through the pixel storage capacitor. Such capacitive coupling schemes are well known, and enable a reduction in the required drive voltages.

It is also possible to use the capacitive coupling method to avoid the need to provide any additional voltage drive levels to the columns. For example, the step of providing a second drive voltage to each pixel for a second period of time can comprise modifying the pixel drive signal to form the second drive voltage by capacitive coupling using the pixel storage capacitor.

Preferably, the step of modifying the pixel drive signal by capacitive coupling comprises applying a voltage waveform to one terminal of the pixel capacitors for each row of pixels. This voltage waveform can have two levels, and the timing of the transitions between the two levels then determines the durations of the first and second periods of time. Alternatively, the voltage waveform can have three levels, and the timing of the transitions between the three levels determines the durations of the first and second periods of time.

The invention also provides a display device comprising an array of liquid crystal pixels, each pixel comprising a thin film transistor switching device and a liquid crystal cell, the array being arranged in rows and columns with each column of pixels sharing a column conductor to which pixel drive signals are provided, wherein the device comprises column driver circuitry for generating analogue pixel drive signals, the column driver circuitry further comprising means for generating at least one reference drive voltage, and wherein the device further comprises timing means for controlling the duration of application of pixel drive signals and of the reference drive voltage to the display pixels.

This display device enables the method of the invention to be implemented. The column driver circuitry may comprise means for generating two reference drive voltages of equal magnitude and opposite polarity.

Examples of the invention will now be described in detail with reference to the accompanying drawings, in which.

Figure 1:
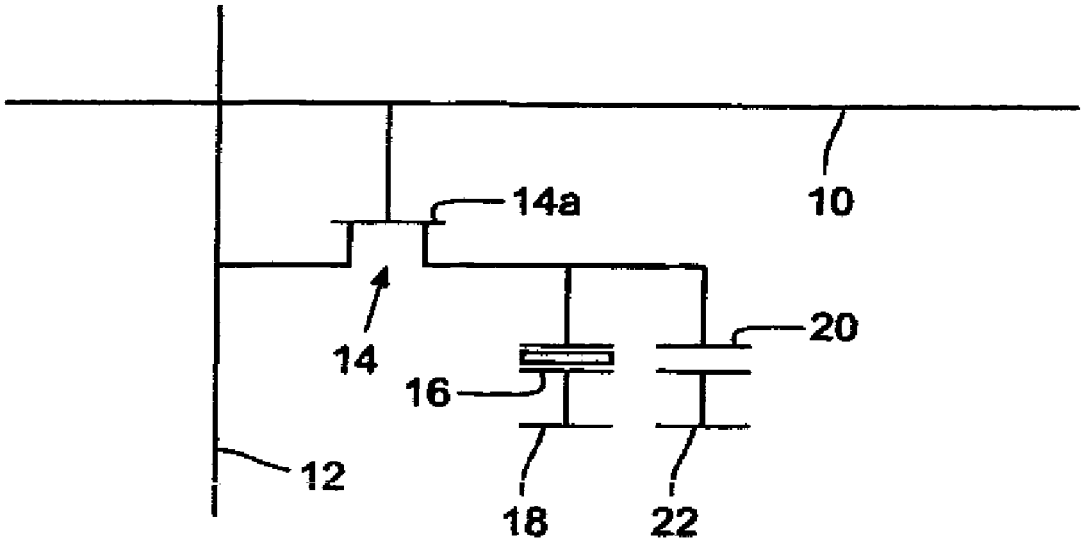
(PRIOR ART) FIG.1
FIG. 1 shows a known liquid crystal pixel circuit.

FIG. 1 shows a conventional pixel configuration for an active matrix liquid crystal display. The display is arranged as an array of pixels in rows and columns. Each row of pixels shares a common row conductor 10, and each column of pixels shares a common column conductor 12. Each pixel comprises a thin film transistor 14 and a liquid crystal cell 16 arranged in series between the column conductor 12 and a common electrode 18 The transistor 14 is switched on and off by a signal provided on the row conductor 10. The row conductor 10 is thus connected to the gate 14*a* of each transistor 14 of the associated row of pixels. Each pixel additionally comprises a storage capacitor 20 which is connected at one end 22 to the next row electrode, to the preceding row electrode, or to a separate capacitor electrode. This capacitor 20 stores a drive voltage so that a signal is maintained across the liquid crystal cell 16 even after the transistor 14 has been turned off. The display uses twisted nematic liquid crystal material, and this invention is of particular use for such displays.

In order to drive the liquid crystal cell 16 to a desired voltage to obtain a required grey level, an appropriate analogue signal is provided on the column conductor 12 in synchronism with a row address pulse on the row conductor 10. This row address pulse turns on the thin film transistor 14, thereby allowing the column conductor 12 to charge the liquid crystal cell 16 to the desired voltage, and also to charge the storage capacitor 20 to the same voltage. At the end of the row address pulse, the transistor 14 is turned off, and the storage capacitor 20 maintains a voltage across the cell 16 when other rows are being addressed. The storage capacitor 20 reduces the effect of liquid crystal leakage and reduces the percentage variation in the pixel capacitance caused by the voltage dependency of the liquid crystal cell capacitance.

The rows are addressed sequentially so that all rows are addressed in one frame period (which will be referred to also interchangeably as a "field period"), and refreshed in subsequent frame periods. It is conventional to charge alternately the liquid crystal material to positive and negative voltages in successive frames, so that the average voltage across the LC cell during operation is zero. This prevents degradation of the material and is known as inversion. The inversion can be carried out row-by-row, or frame-by-frame, or there are other inversion schemes.

Figure 2:
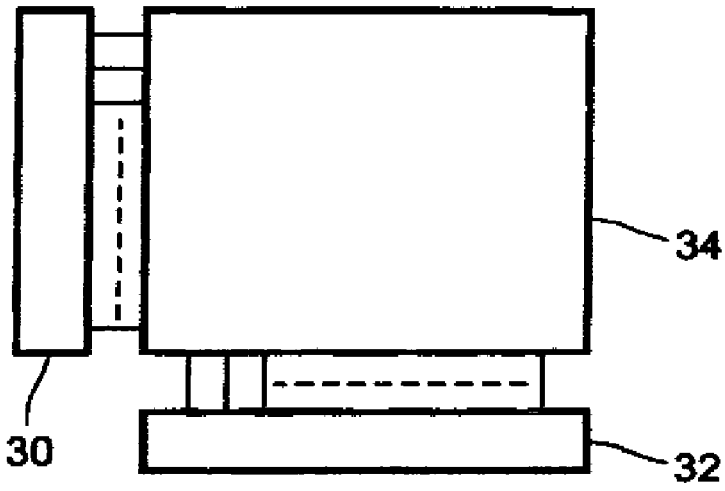
FIG.2 (PRIOR ART)
FIG. 2 shows the general components of a liquid crystal display.

As shown in FIG. 2, the row address signals are provided by row driver circuitry 30, and the pixel drive signals are provided by column address circuitry 32, to the array 34 of display pixels. The column address circuitry includes digital to analogue converters (DACs) for converting a digital control signal, for example a 6 bit control signal, into an appropriate analogue level for driving a column conductor 12 associated with the DAC.

Figure 3:
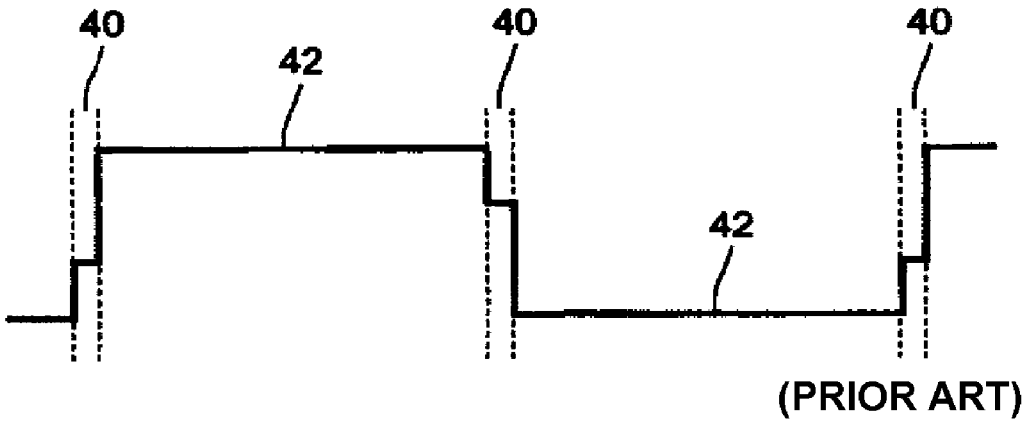
FIG. 3 shows a conventional voltage waveform applied to a liquid crystal display element.

In conventional active matrix liquid crystal displays, the voltage waveforms appearing across the liquid crystal elements consist of two periods, as illustrated in FIG. 3. There is a set-up or addressing period 40 during which the pixel is addressed with video data supplied via the column electrodes of the display and during which, for example in the case of capacitively coupled drive schemes, an additional voltage may be coupled onto the pixel. There is then a hold period 42 during which the voltage across the liquid crystal element is maintained at a substantially constant value. The ratio of the hold period to the set-up period is large, for example 100:1 or more, so that the rms and mean voltages across the liquid crystal elements are determined mainly by the voltages present during the hold period. FIG. 3 also shows inversion between two successive fields.

This invention proposes that the voltage waveforms appearing across the liquid crystal elements are modified by changing the voltage across the elements during the hold period 42. This change in voltage can be achieved in a number of ways without requiring adjustable voltage sources.

Figure 4:
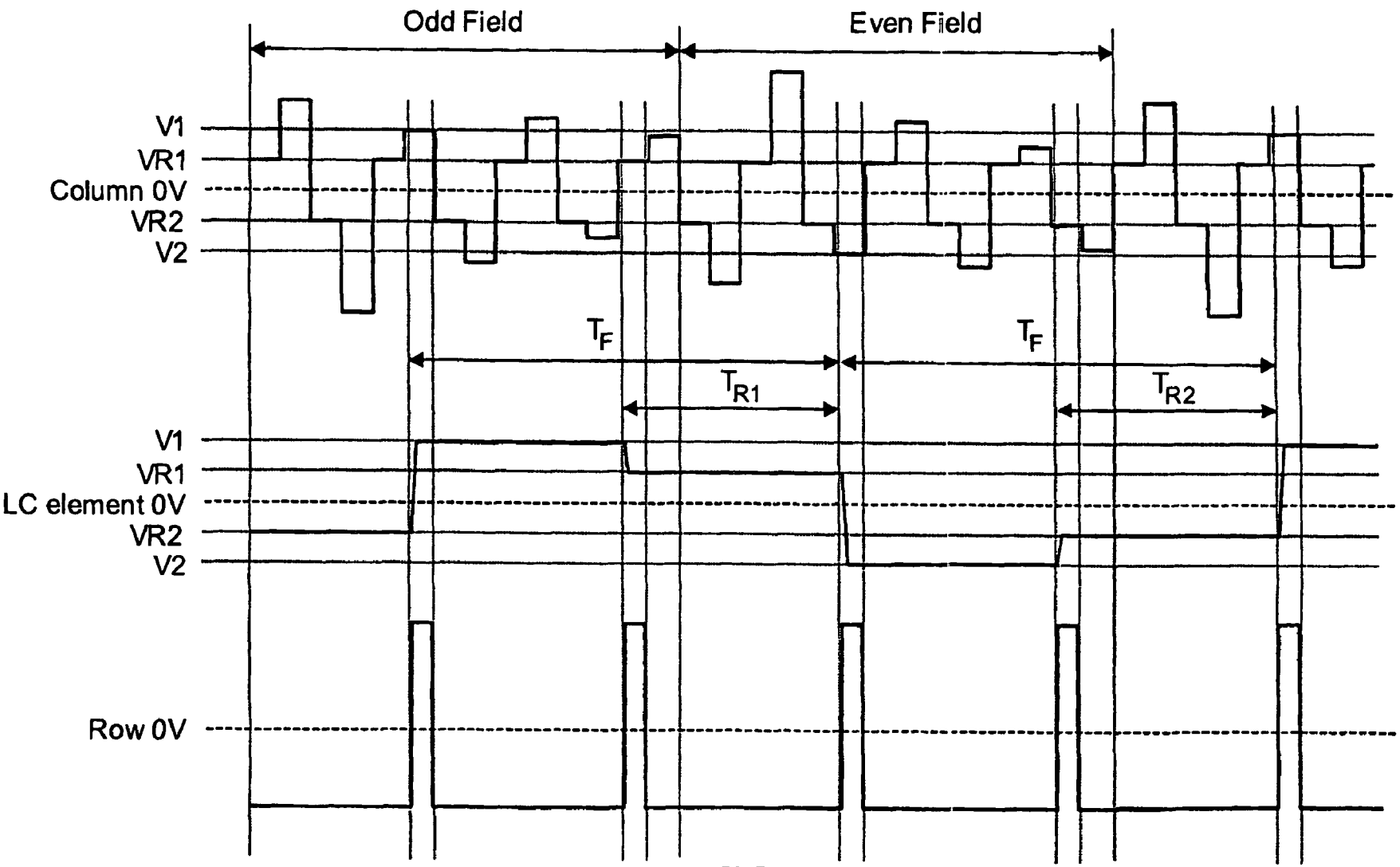
FIG. 4 shows a timing diagram for a first control method of the invention.

A first implementation of the invention is explained with reference to FIG. 4. FIG. 4 also shows two successive field periods.

The top plot in FIG. 4 shows the column driver output voltage waveform for one column conductor. Each step in the waveform is the signal for a specific row. As will become apparent from the following description, there are two steps in the column voltage for each row within each field. Thus, the sequence of voltage steps labeled "Odd Field" comprises 14 voltage steps, and this represents two voltage levels for each of 7 rows. It is assumed for simplicity that the display consists of seven rows of pixels, although in practice the number of rows will be much greater than this.

The voltage level on the column conductor is loaded into the pixel when a row pulse is present. The bottom plot in FIG. 4 shows the row signal for one row of the display. As shown, there are two row pulses within each field period $T_F$, so that a voltage level is loaded into a pixel twice per field.

FIG. 4 represents the case of a drive scheme in which the full LC drive voltage is applied to the columns of the display, and a row by row inversion of the pixel drive voltage polarity is used. Thus, the column voltage waveform comprises a repeating sequence of two voltage levels for a positively addressed pixel followed by two voltage levels for a negatively addressed pixel.

Each row in the display is addressed twice during every field period. The first time that a row of pixels is addressed, the columns are set at voltage levels determined from the video information in the conventional way. Thus, timed with the first row address pulses in the two fields shown are column voltages of values V1 and V2. These voltage values V1 and V2 can be any voltage within the normal output range of conventional D/A converter circuits within the column driver circuitry.

The second time that the row is addressed within each field period, the columns are held at a reference voltage level. The reference voltage level may take on different values depending on the polarity of the previous video drive voltage, for example VR1 and VR2 as indicated in FIG. 4. There are, however, only two reference voltage levels (in this example), so that little or no additional circuitry is required to generate these voltage levels for application to the column conductors.

If the time for which the pixel voltage is set at the reference level is denoted $T_{R1}$ and $T_{R2}$, the field period is denoted $T_F$ and $k_{Rn}$ represents the ratio $T_{Rn}/T_F$ then the rms (root mean square) voltage across the liquid crystal element addressed by the row and column waveforms shown in FIG. 4 can be represented by the following equation:

$$V_{rms} = \left(\frac{V1^2(1-k_{R1})}{2} + \frac{V2^2(1-k_{R2})}{2} + \frac{VR1^2 k_{R1}}{2} + \frac{VR2^2 k'_{R2}}{2}\right)^{0.5}$$

By adjusting the values of VR1, VR2, $T_{R1}$ and $T_{R2}$ the drive voltages experienced by the liquid crystal elements can be controlled to adjust the contrast and brightness of the display. Consider the simplified example where:

$V1=-V2=V$ (so that in the two successive fields, the pixel is driven to the same brightness)

$VR1=-VR2=VR$ (so that equal and opposite reference voltages are provided) and $k_{R1}=k_{R2}=k$ The equation then becomes:

$$V_{rms}=(V^2(1-k)+VR^2k)^{0.5}$$

Figure 5:
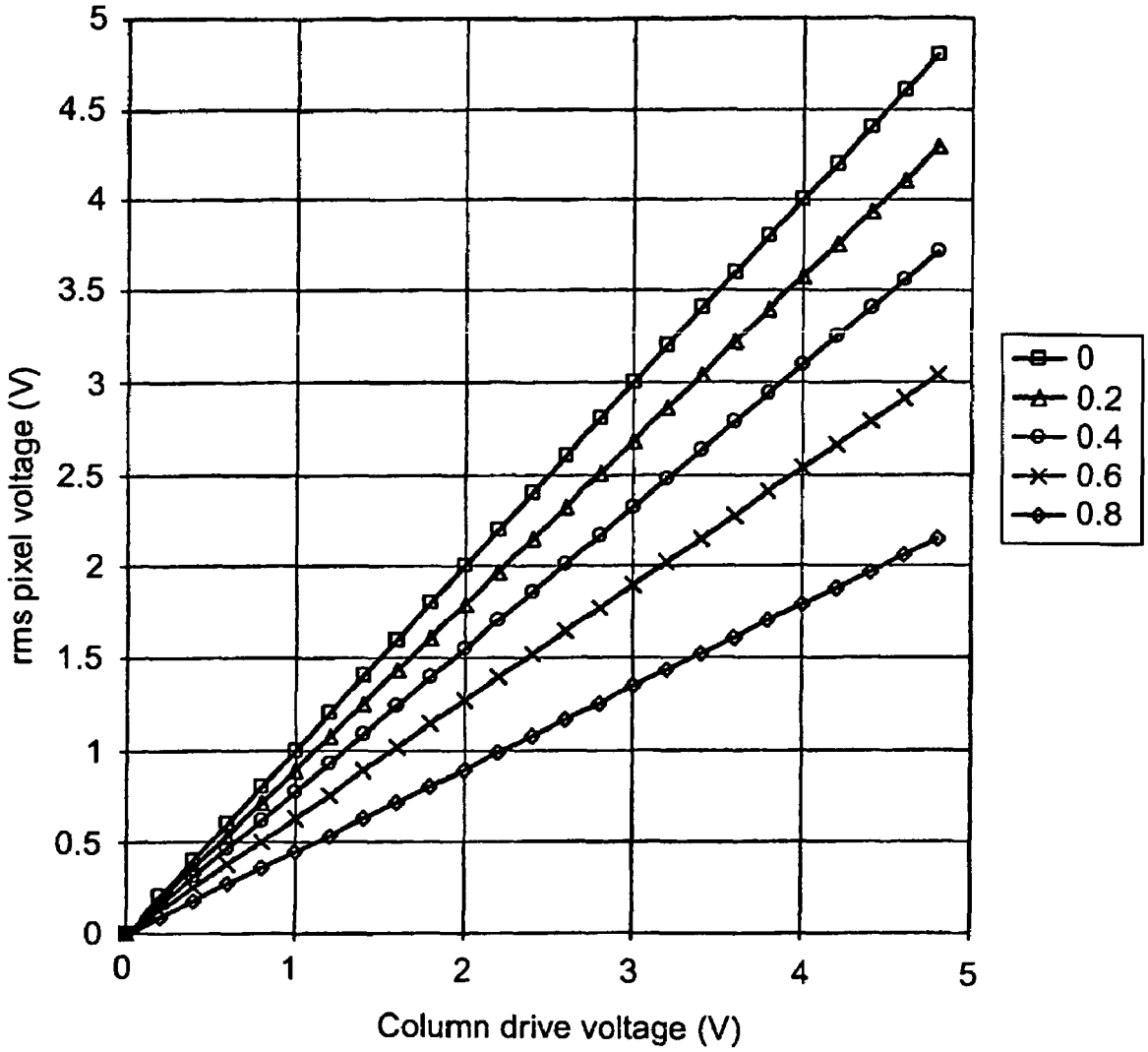
FIG. 5 shows a first control scheme using the method of FIG. 4.

FIG. 5 shows the relationship between the rms voltage and the column drive voltage V for VR=0V and for different values of k. FIG. 5 shows the effect of different values of k from 0 to 0.8 on the pixel rms voltage. It can be seen that the parameter k effectively modifies the amplitude of the drive signals applied to the display elements with the drive amplitude for a column drive voltage of 0V remaining unchanged. Thus, for a drive voltage of 0V, the display element drive voltage is independent of k.

Figure 6:
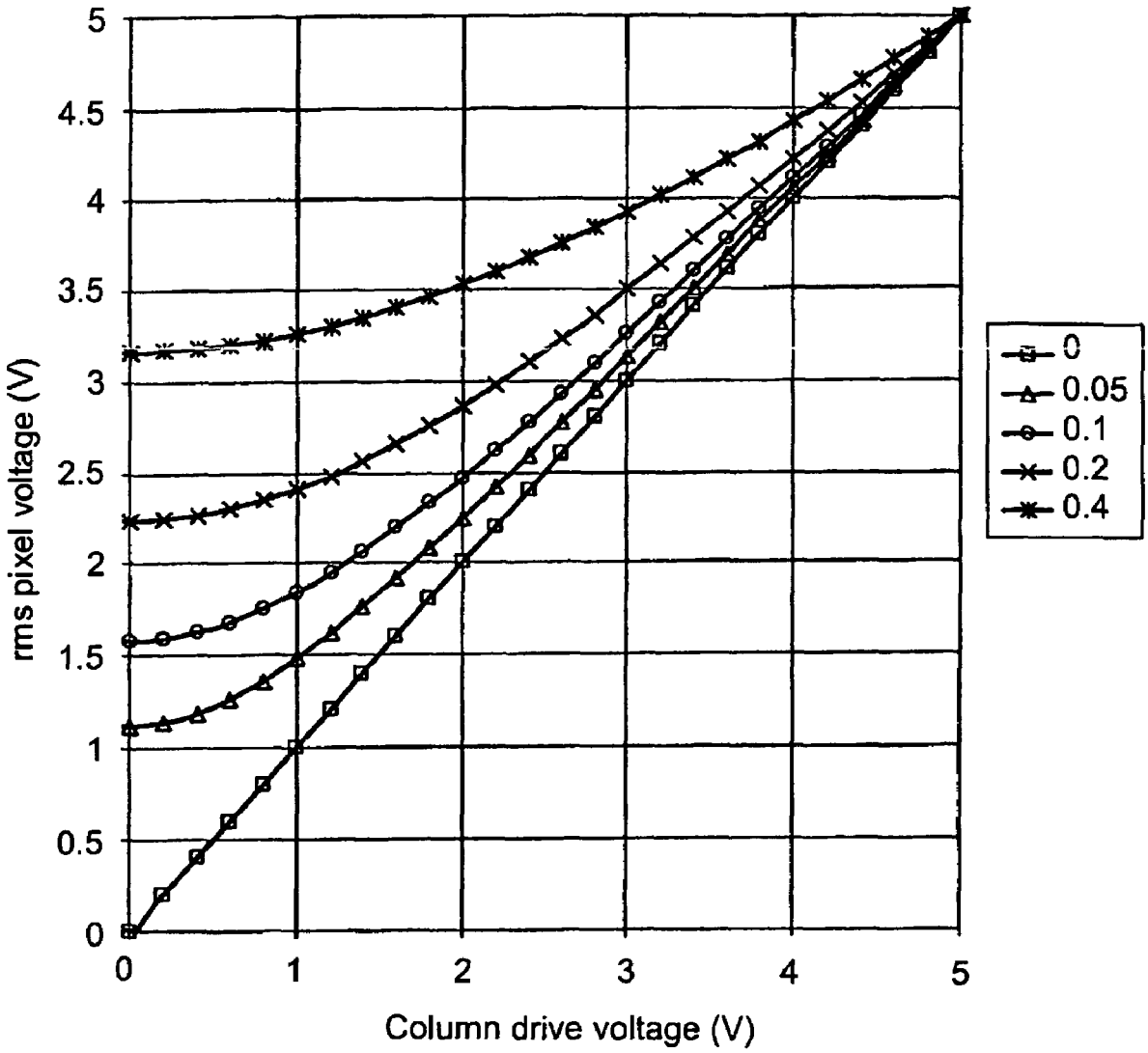
FIG. 6 shows a second control scheme using the method of FIG. 4.

The value of the column drive voltage for which the display element drive voltage is independent of k can be controlled by the values of VR1 and VR2. For example if VR1=5V and VR2=−5V then the pixel drive voltage can be controlled as illustrated in FIG. 6, which shows the effect of different values of k from 0 to 0.4 on the pixel rms voltage. If the display used a normally white LC effect the value of k would effectively operate like a contrast control. The high value of pixel voltage (5Vrms) corresponds to the dark state of the liquid crystal and this drive voltage remains unchanged as k is varied. The lower drive voltages, which correspond to lighter pixels, are modified by the value of k.

Figure 7:
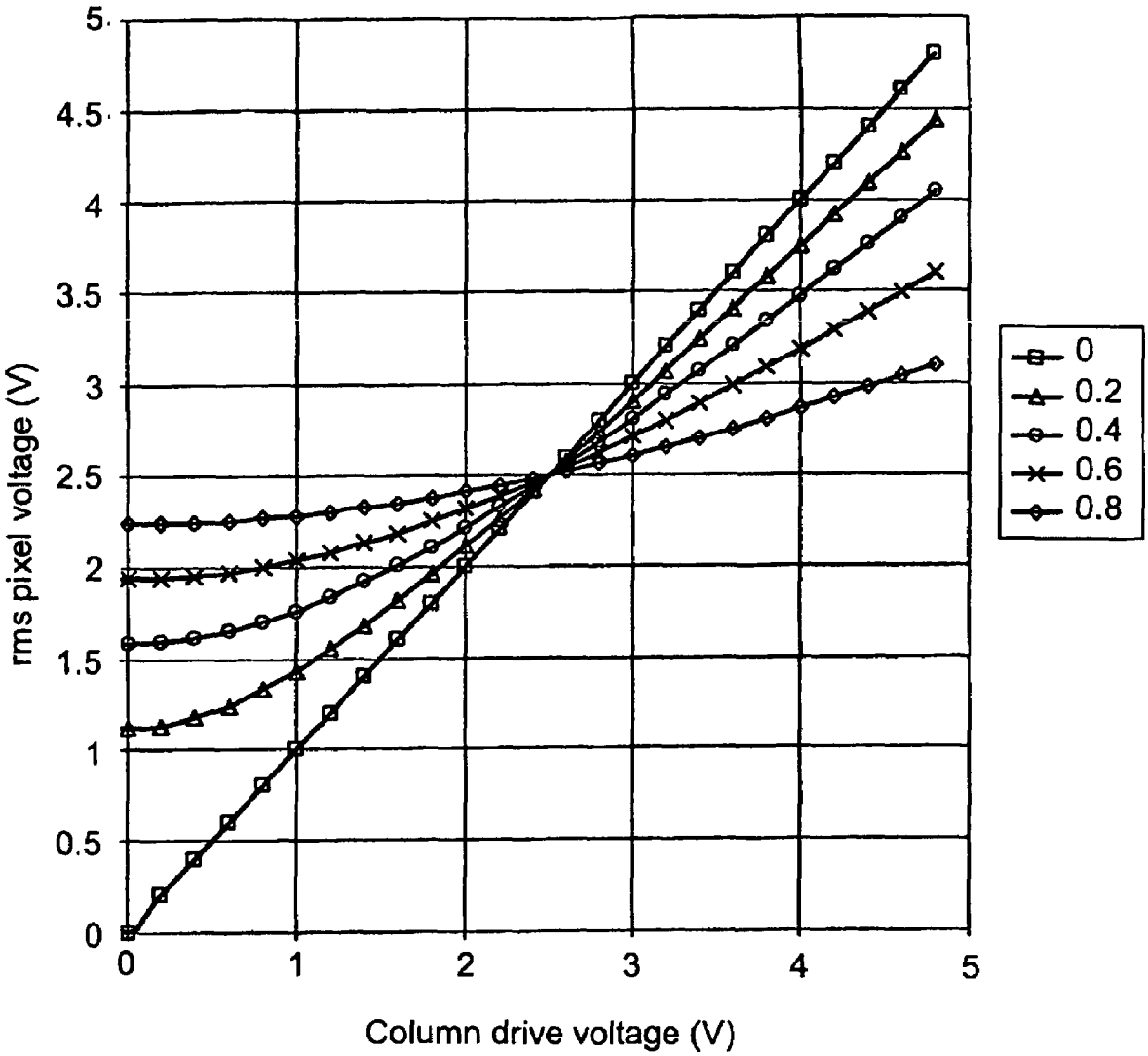
FIG. 7 shows a third control scheme using the method of FIG. 4.

By selecting intermediate values of VR1=2.5V and VR2=−2.5V it is possible to alter the drive voltages for dark and light pixels by varying k while leaving the drive voltage for mid-grey pixels unchanged. This is illustrated in FIG. 7, which shows effect of different values of k from 0 to 0.8.

The technique of resetting the pixel voltage to a reference voltage level some time after it has been addressed with video information allows a simple change to the timing of the drive waveforms to be used to control the drive voltages applied to the display pixels.

Figure 9:
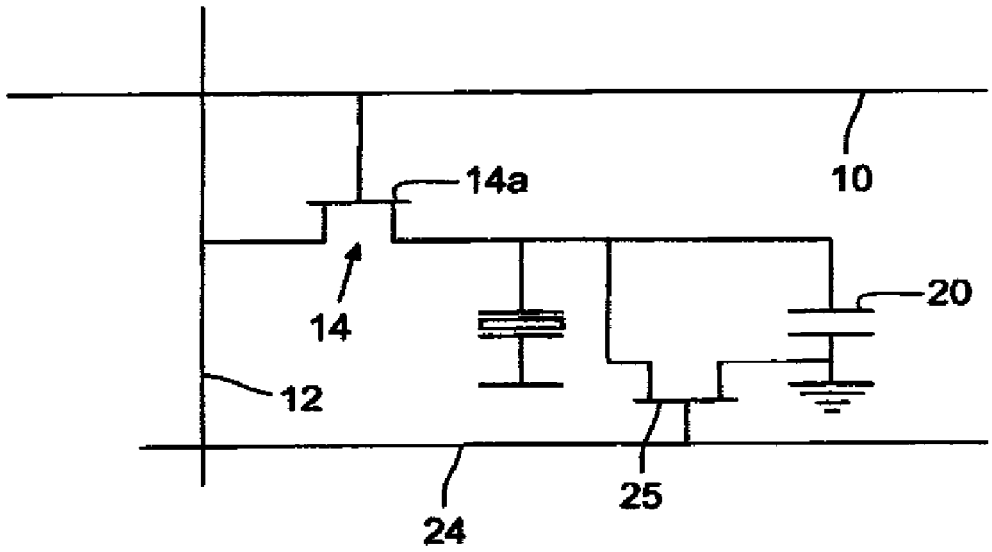
FIG. 9 shows a modified pixel circuit for use with the method of FIG. 8.
Figure 8:
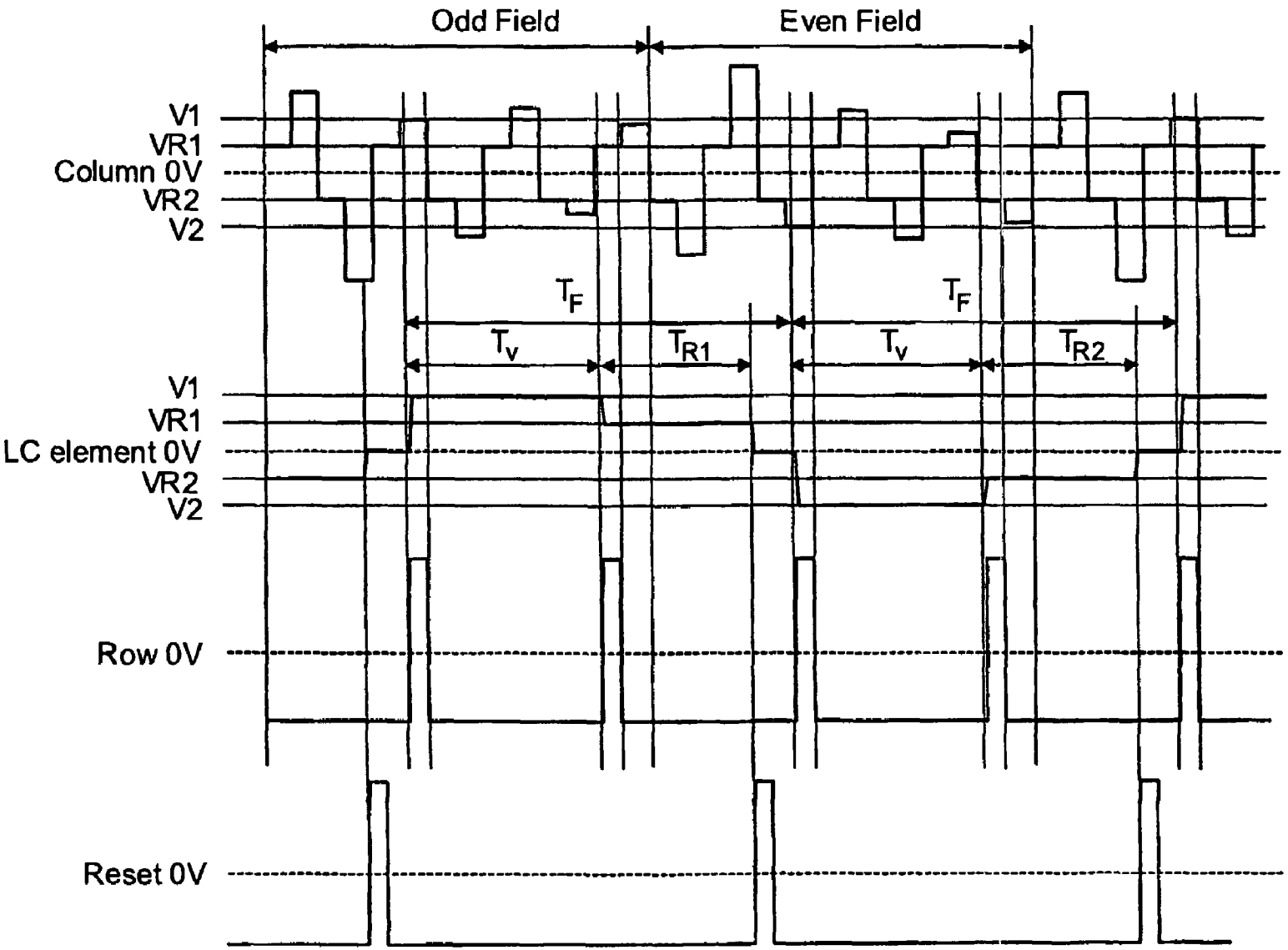
FIG. 8 shows a timing diagram for a second control method of the invention.

A second implementation of the invention is explained with reference to FIG. 8. The top three plots of FIG. 8 correspond to the top three plots of FIG. 4. In addition, a reset pulse is shown as the bottom plot. The control scheme of FIG. 8 is for a modified pixel circuit which includes a reset capability. This modified pixel is shown in FIG. 9.

As shown, an additional reset transistor 25 is provided for shorting the storage capacitor 20. In this case, the capacitor electrode is connected to ground. The reset transistor is controlled by a reset line 24.

By increasing the complexity of the pixel drive further it is possible to provide additional control of the pixel drive voltages. In this case, the mean as well as the rms pixel voltage can be controlled. In this example, the pixel voltage is changed from the video drive level (V1 or V2) to the reference level (VR1 or VR2) after a time period $T_V$. After a further time period $T_{R1}$ or $T_{R2}$ the pixel voltage is reset to 0V. In this example, the resetting of the pixel voltage is performed using the additional TFT 25 and addressing electrode 24. Thus, a series of reset pulses are provided on the reset line 24, and these are shown as the bottom plot in FIG. 8. The resetting is near the end of the field period, so that a short period of zero volts appears across the LC element at the end of the field period.

The pixel voltage can alternatively be reset by applying an appropriate voltage to the column electrode and turning on the conventional pixel addressing TFT T1 for a third time.

If $k_V=T_V/T_F$, $k_{R1}=T_{R1}/T_F$ and $k_{R2}=T_{R2}/T_F$, then the rms and mean voltages across the liquid crystal elements are given by the equations:

$$V_{rms} = \left(\frac{V1^2 k_V}{2} + \frac{V2^2 k_V}{2} + \frac{VR1^2 k_{R1}}{2} + \frac{VR2^2 k_{R2}}{2}\right)^{0.5}$$

-continued $$V_{mean}=\left(\frac{V1k_V}{2}+\frac{V2k_V}{2}+\frac{VR1k_{R1}}{2}+\frac{VR2k_{R2}}{2}\right)$$

Consider the simplified example where:

$V1=-V2=V$ $VR1=-VR2=VR$ and $k_{R1}=k_{rms}+k_{mean}$ and $k_{R2}=k_{rms}-k_{mean}$ The equations then simplify to give:

$V_{rms}=(V^2k_v+VR^2k_{rms})^{0.5}$ $V_{mean}=VRkmean$

The values of $k_{rms}$ and $k_{mean}$ (which can be selected, and the values $k_{R1}$ and $k_{R2}$ then calculated) provide independent control of the rms and the mean pixel drive voltages simply by modifying the timing of the waveforms applied to the reset addressing electrodes of the display.

Figure 10:
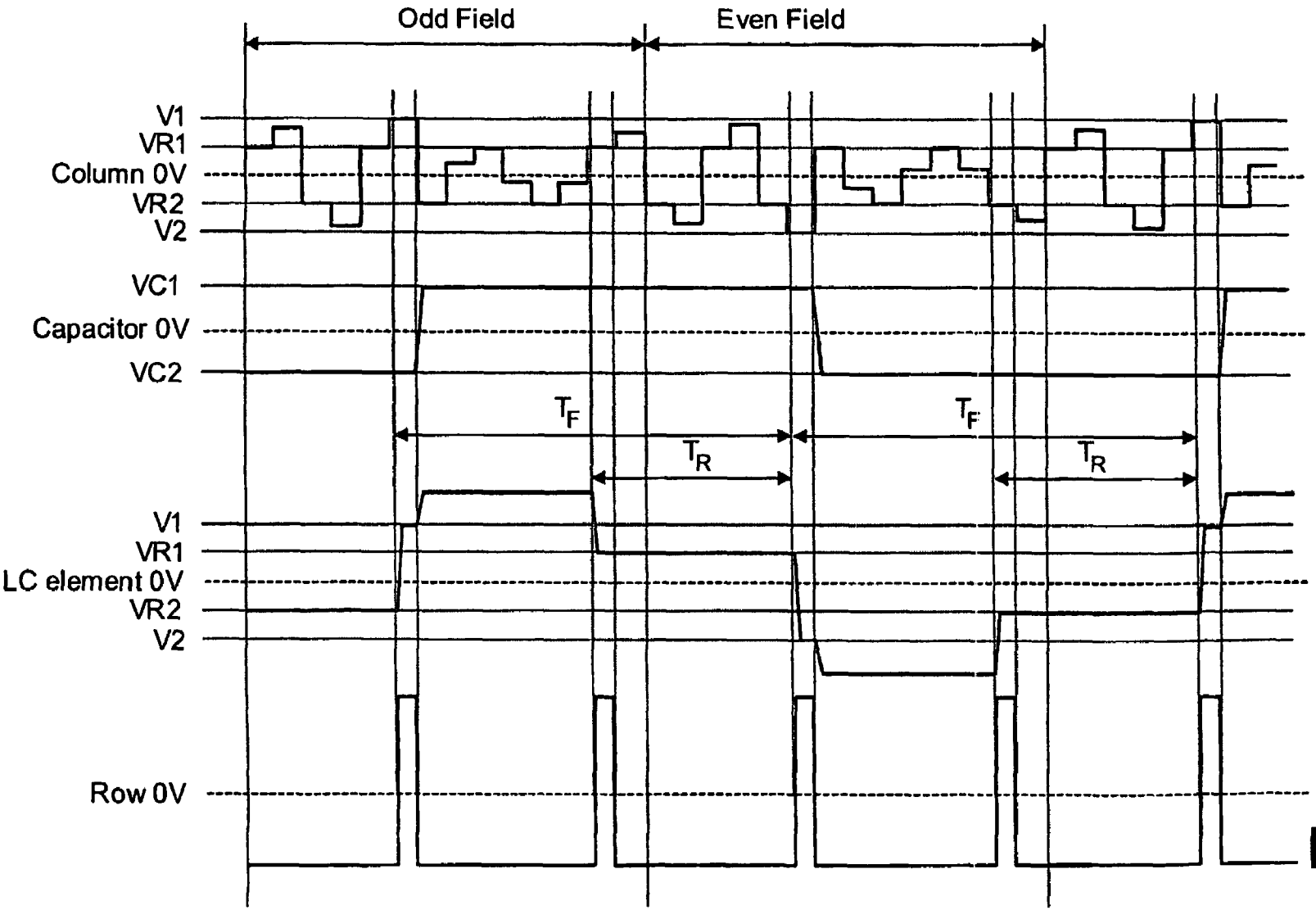
FIG. 10 shows a timing diagram for a third control method of the invention.

A third implementation of the invention is explained with reference to FIG. 10, for a capacitively coupled drive scheme. In capacitively coupled drive schemes, part of the drive voltage applied to the display elements is coupled onto the pixels via the pixel storage capacitors. In one example of such a scheme, the voltage on the capacitor electrode 22 is no longer constant, and is caused to fluctuate. This enables the voltage swing on the column electrode 12 to be reduced.

There are other drive schemes which rely upon capacitive coupling, and which may be modified by the method of the invention.

The top plot and the bottom two plots of FIG. 10 again correspond to those in FIG. 4. The second plot shows the signal for application to the pixel storage capacitor. This alternates between two levels CV1 and VC2, and switches with timing corresponding to the field period.

Consider the simplified example where:

$V1=-V2=V$ $VR1=-VR2=VR$ and $VC1-VC2=VC$

The equation then becomes:

$V=((V+k_cVC)^2(1-k_R)+VR^2k_R)^{0.5}$

Figure 11:
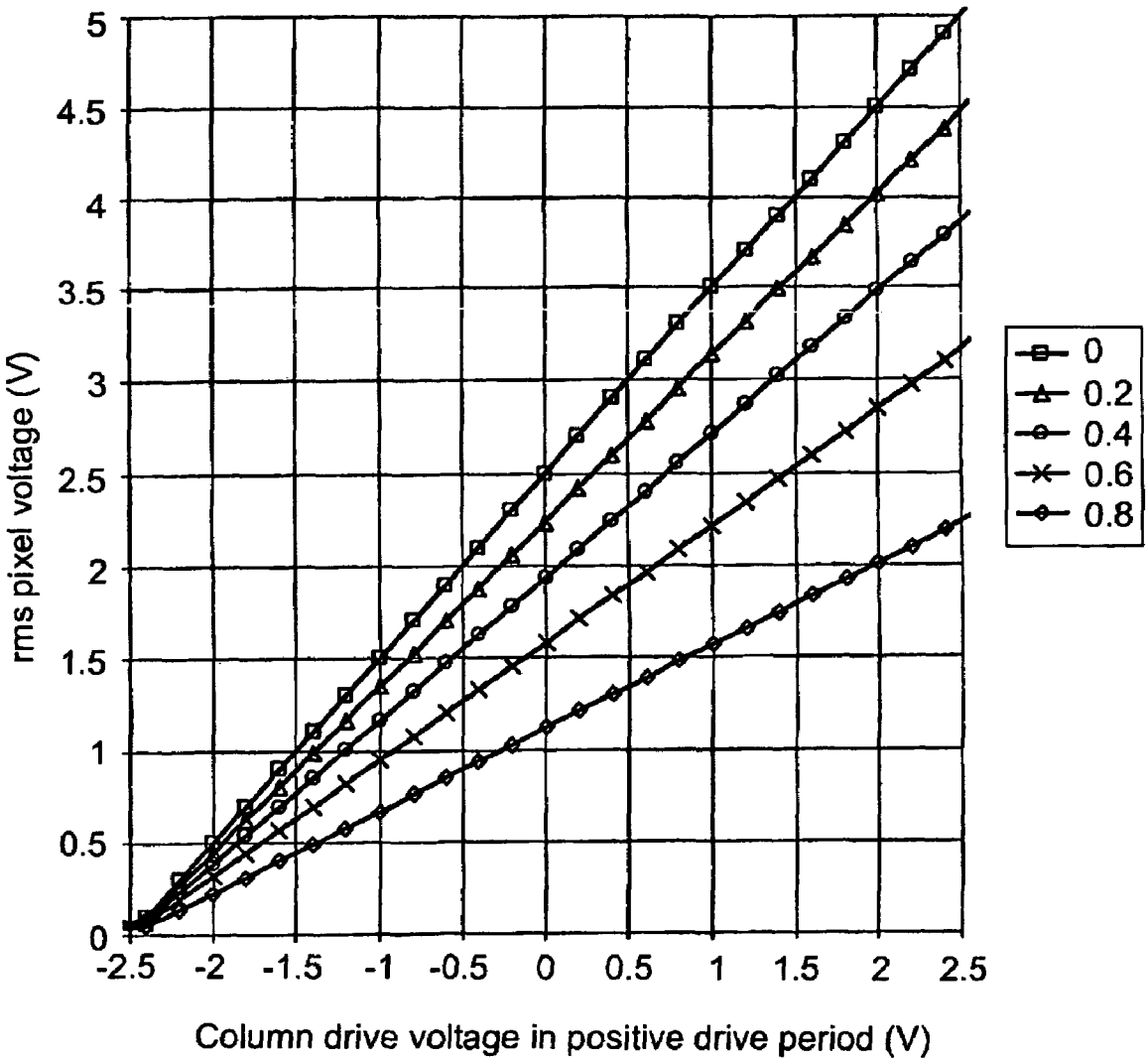
FIG. 11 shows a control scheme using the method of FIG. 10.

The dependence of the rms voltage across the display element on the column drive voltage in a positive addressing period and the parameter $k_R$ is shown in FIG. 11, which shows the effect of different values of $k_R$ from 0 to 0.8 on the pixel rms voltage. As in the previous example, the reference voltage values, VR1 and VR2, can be changed in order to modify the effect is that the parameter $k_R$ has on the drive characteristics.

Figure 12:
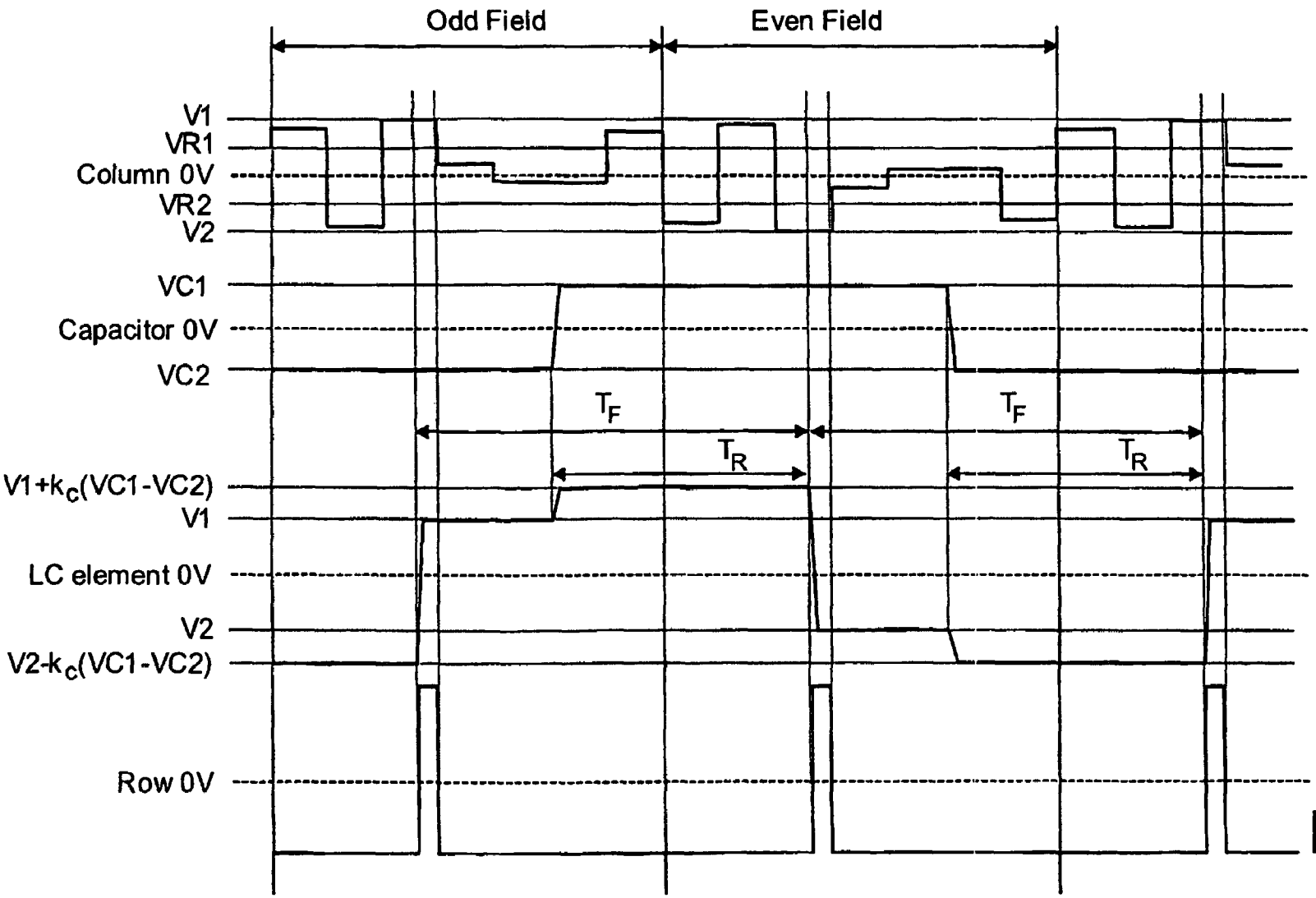
FIG. 12 shows a timing diagram for a fourth control method of the invention.

A fourth implementation of the invention is explained with reference to FIG. 12, the plots of which correspond to those of FIG. 10.

This provides an alternative method for controlling the pixel drive voltages when using a capacitively coupled drive scheme.

The coupling of the additional drive voltage onto the pixel following the addressing of the pixel with video information is delayed for a period ($T_F-T_R$). In this case, the pixel is not addressed for a second time during the hold period, so that the row address pulse has only one pulse per field period. Instead, the capacitively coupled voltage provides the second voltage (which is now dependent on the data voltage), and the timing of application of the capacitively coupled voltage is used to control the pixel output characteristics. In this case, the second drive voltage may be the normal desired pixel voltage, and the application of this voltage is delayed.

In this scheme, the reference voltages VR1 and VR2 are not used, and data is loaded from the column to the pixel only once in each field period. Thus, the column voltage waveform has half the number of transitions as shown in FIG. 12, and the row address pulse can be widened (although this is not shown in FIG. 12).

The equation for the rms voltage across the display element now becomes:

$$V_{rms}=\left((V1^2+V2^2)\left(\frac{1-k_R}{2}\right)+((V1+k_C(VC1-VC2))^2+(V2-k_C(VC1-VC2))^2)\frac{k_R}{2}\right)^{0.5}$$

In this example, the voltage across the display element after it is first addressed is determined by the voltage applied via the column electrode, V1 or V2, and the additional voltage which is coupled onto the pixel via the pixel storage capacitor $k_C$(VC1−VC2). The parameter $k_c$ depends on the values of the capacitances within the pixels and represents the fraction of the change in voltage on the pixel storage capacitor electrode which is coupled onto the pixel electrode. A time ($T_F-T_R$) after the pixel is first addressed it is re-addressed with the reference voltage, VR1 or VR2. The rms voltage appearing across the display element can be approximated by the following equation:

$$V_{rms}=\left(((V1+k_C(VC1-VC2))^2+(V2-k_C(VC1-VC2))^2)\left(\frac{1-k_R}{2}\right)+(VR1^2+VR2^2)\frac{k_R}{2}\right)^{0.5}$$

Consider the simplified example where:

$V1=-V2=V$ $VR1=-VR2=VR$ and $VC1-VC2=VC$

The equation then becomes:

$V_{rms}=(V^2(1-k_R)+(V+k_cVC)^2k_R)^{0.5}$

Figure 13:
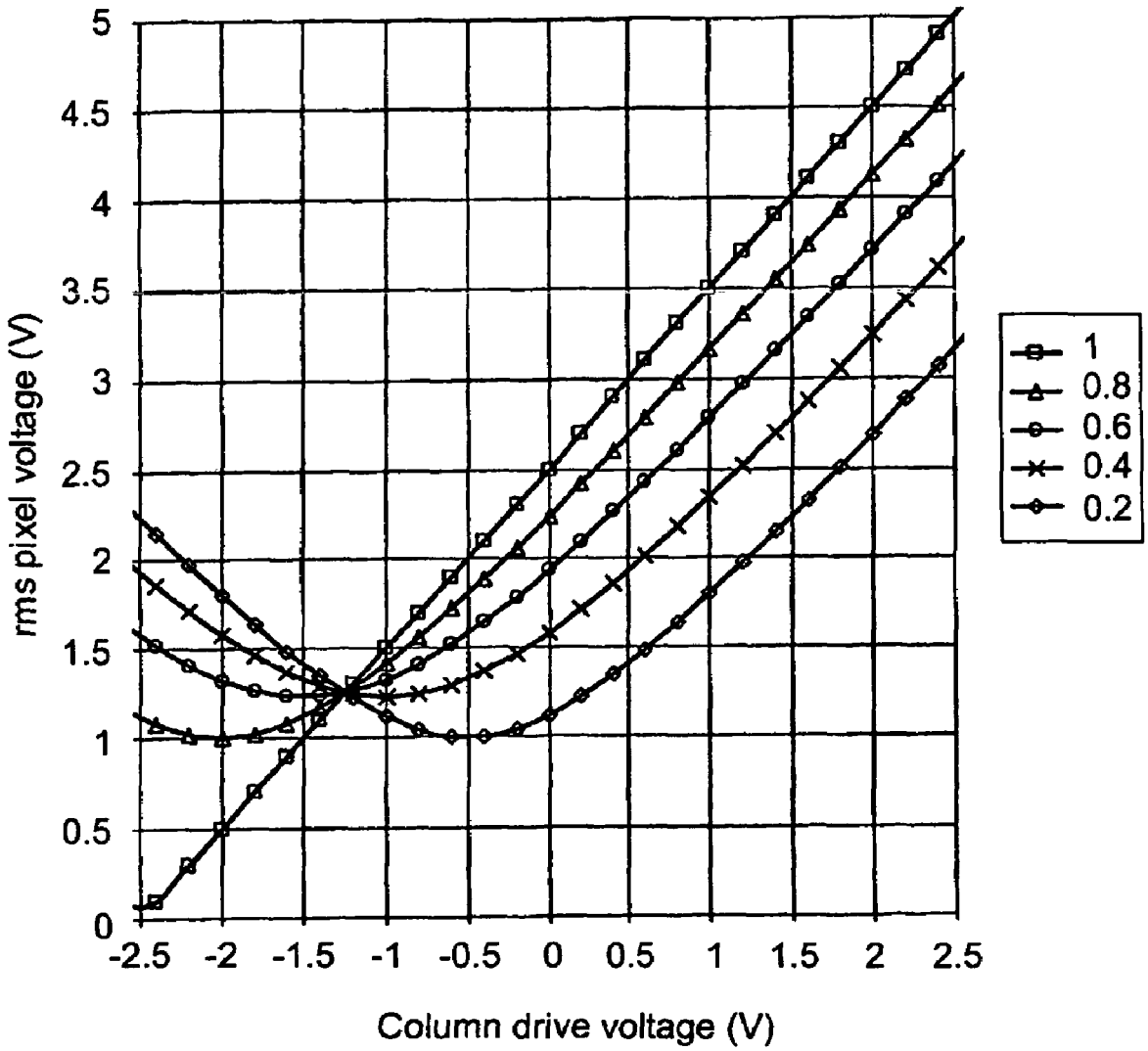
FIG. 13 shows a control scheme using the method of FIG. 12.

This technique can be used to provide limited adjustments to the pixel drive voltages. FIG. 13 shows the effect of different values of $k_R$ from 1 to 0.2 on the pixel rms for this capacitively coupled drive scheme.

As can be seen in FIG. 13, the fact that the voltage initially applied to the display element, before the additional drive voltage is coupled on, can be both positive and negative causes the slope of the rms pixel voltage characteristic to become inverted. This problem can be overcome by using more complex drive waveforms.

Figure 14:
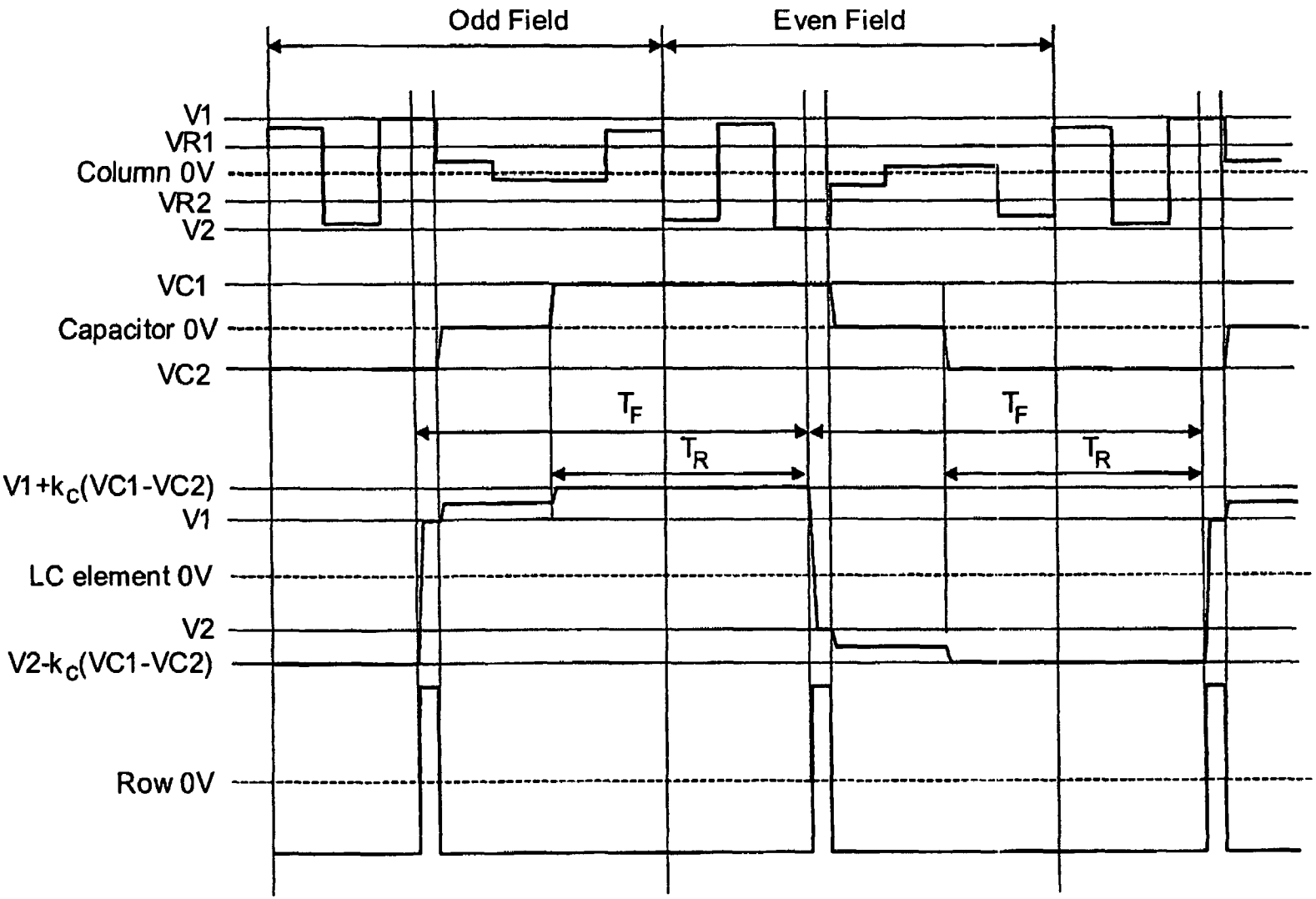
FIG. 14 shows a timing diagram for a fifth control method of the invention.
Figure 15:
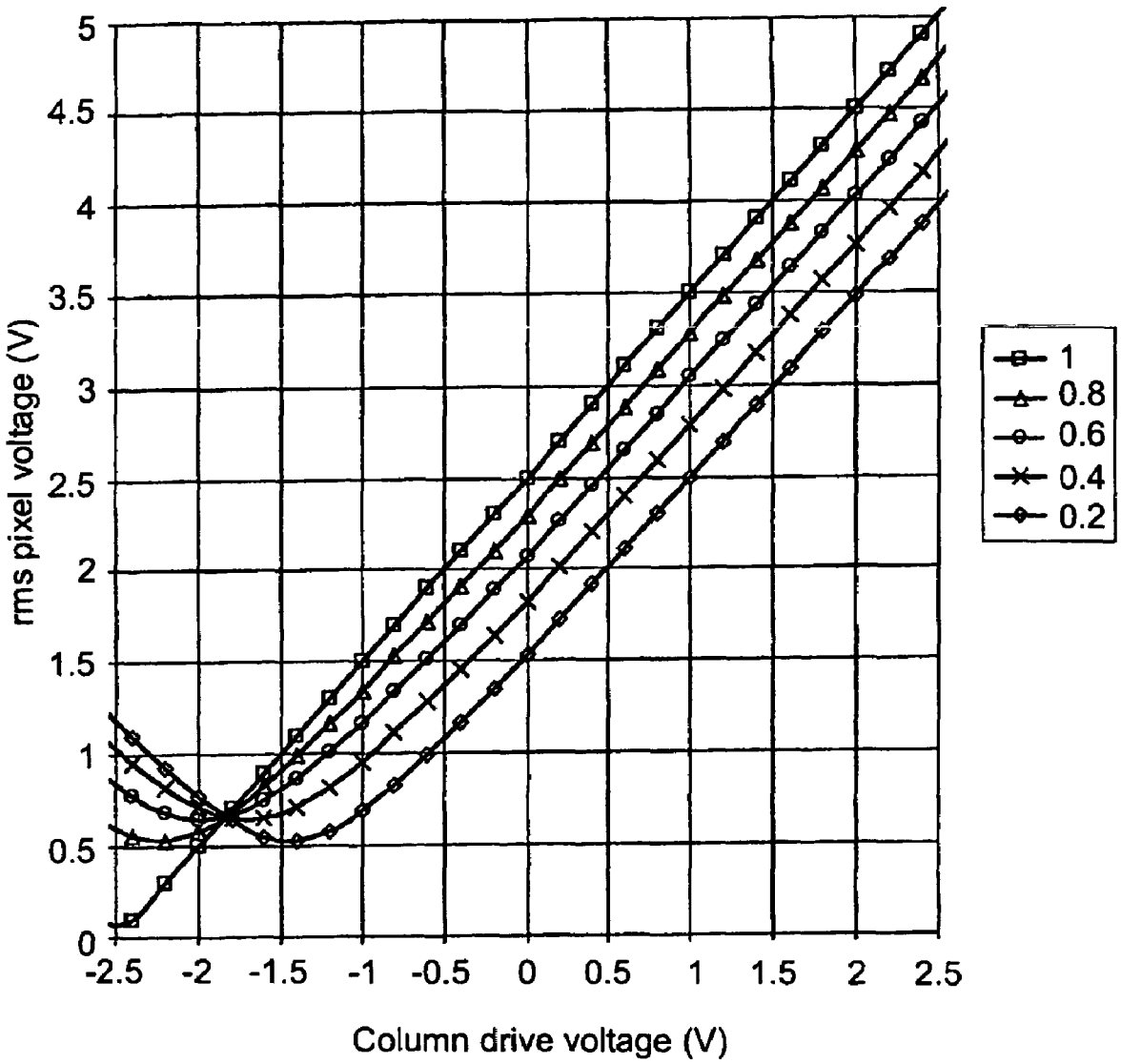
FIG. 15 shows a control scheme using the method of FIG. 14.

By using a three level capacitor drive waveform as shown in FIG. 14 (having plots corresponding to those of FIG. 12) the rms drive pixel voltage characteristics shown in FIG. 15 can be produced. FIG. 15 again shows the effect of different values of $k_R$ from 1 to 0.2 on the pixel rms voltage for this modified capacitive drive scheme.

Shortly after the pixel is addressed with video information the capacitor electrode is taken from a first to a second voltage level. This ensures that the voltage across the pixel has the same polarity for all possible column drive voltage levels.

As an alternative to using a three level capacitor drive waveform it is possible to divide the pixel storage capacitor into two parts driven with two level waveforms having different timing. After the pixel has been addressed a fraction of the required capacitively coupled voltage is applied to the pixel by switching the signal applied to the first part of the pixel storage capacitor. Then after a further time period the full capacitively coupled voltage is applied to the pixel by switching the signal applied to the second part Of the pixel storage capacitor.

The techniques described above are most obviously applicable to active matrix LCDs, particularly twisted nematic LC displays, but might also be useful in other active matrix devices with appropriate modification.

Application of the technique to AMLCDs with full column voltage drive schemes and capacitively coupled drive schemes has been described although it could also be used with other drive schemes such as common electrode drive.

Thus, although specific examples have been described above, the invention can be implemented in a variety of other ways, in order to drive each pixel in two stages. In some examples above, the pixel is re-addressed and the pixel capacitance charged or discharged to a different voltage level. In other examples, the coupling of additional voltages onto the pixel is delayed in capacitively coupled schemes. Alternatively, this capacitively coupled signal can be removed before the end of the hold period or by coupling additional voltages onto the pixel in two or more steps. These modifications to the voltage waveforms appearing across the liquid crystal elements can be achieved by modifying the pixel circuit by providing additional transistors, capacitors and addressing electrodes. Alternatively it may be preferable to implement these modifications simply by changing the drive waveforms applied to conventional pixel circuits.

The timing changes which are used as the control parameters in the examples above can be implemented using digital circuits which can readily be fabricated using thin film transistors. This control of the drive voltage across the liquid crystal elements is not applied on a pixel by pixel basis, i.e. to control the grey level of individual pixels, but is applied either to regions of the display or to the complete display, for example to adjust the overall brightness or contrast of the display.

Various other modifications will be apparent to those skilled in the art.

The invention claimed is:

1. A method of controlling a display device comprising an array of display pixels, each pixel comprising a thin film transistor switching device and a display element, the array being arranged in rows and columns with each column of pixels sharing a column conductor to which pixel data voltages are provided, the method comprising, for each field period during which data is stored into the array of pixels:

providing a pixel drive signal to each pixel for storage on the pixel for a first period of time, the pixel drive signal comprising a selected one of a plurality of pixel drive levels;

providing a second drive voltage to each pixel for a second period of time, wherein the durations of the first and second periods of time are controlled to vary the pixel light output.

2. A method as claimed in claim 1, wherein the pixel drive signal is provided to each pixel by providing a first row pulse on a row conductor timed with the application of a pixel data voltage on the column conductor.

3. A method as claimed in claim 2, wherein the second drive voltage is provided to each pixel by providing a second row pulse on a row conductor timed with the application of the second drive voltage on the column conductor.

4. A method as claimed in claim 3, wherein the durations of the first and second periods of time are controlled by selecting the timing of the second row pulse relatively to the first row pulse.

5. A method as claimed in claim 1, wherein each pixel is addressed with a first polarity in a first group of field periods and with a second opposite polarity in a second group of field periods.

6. A method as claimed in claim 5, wherein the second drive voltage comprises a fixed reference drive voltage, and wherein a first reference drive voltage is provided for pixels driven to the first polarity and a second reference drive voltage is provided for pixels driven to the second polarity.

7. A method as claimed in claim 6, wherein the first reference drive voltage is of equal magnitude and opposite polarity to the second reference drive voltage.

8. A method as claimed in claim 1, wherein the durations of the first and second periods of time are together substantially equal to the field period.

9. A method as claimed in claim 1, wherein the method further comprises providing zero volts to each pixel for a third period of time.

10. A method as claimed in claim 9, wherein the durations of the first, second and third periods of time are together substantially equal to the field period.

11. A method as claimed in claim 9, wherein providing zero volts to each pixel comprises resetting the pixel by discharging a pixel storage capacitor.

12. A method as claimed in claim 9, wherein the method comprises controlling the durations of the first, second and third periods of time to vary the pixel light output.

13. A method as claimed in claim 1, wherein each pixel comprises a pixel storage capacitor, and wherein the step of providing a pixel drive signal to each pixel for storage on the pixel for a first period of time comprises applying a pixel data voltage to the column and forming the pixel drive signal by capacitive coupling using the pixel storage capacitor.

14. A method as claimed in claim 1, wherein each pixel comprises a pixel storage capacitor, and wherein the step of providing a second drive voltage to each pixel for a second period of time comprises modifying the pixel drive signal to form the second drive voltage by capacitive coupling using the pixel storage capacitor.

15. A method as claimed in claim 14, wherein the step of modifying the pixel drive signal by capacitive coupling comprises applying a voltage waveform (Capacitor) to one terminal of the pixel capacitors for each row of pixels.

16. A method as claimed in claim 15, wherein the voltage waveform (Capacitor) has two levels, and the timing of the-transitions between the two levels determines the durations of the first and second periods of time.

17. A method as claimed in claim 15, wherein the voltage waveform (Capacitor) has three levels, and the timing of the transitions between the three levels determines the durations of the first and second periods of time.

18. A method as claimed in claim 14, wherein each pixel is addressed with a first polarity in a first group of field periods and with a second opposite polarity in a second group of field periods.

19. A method as claimed in claim 1, wherein the plurality of pixel drive levels correspond to a 4, 6, 8 or 10 bit pixel drive signal.

20. A method as claimed in claim 1, wherein the second period of time can be varied between a duration of 0 and at least 0.5 times the field period.

21. A method as claimed in claim 1, wherein the display pixels comprise twisted nematic liquid crystal display pixels.

22. A method as claimed in claim 1, wherein the second drive voltage corresponds to a drive level for the pixel which is between the brightest and darkest pixel drive levels.

23. A display device comprising an array of display pixels, each pixel comprising a thin film transistor switching device and a display element, the array being arranged in rows and columns with each column of pixels sharing a column conductor to which pixel drive signals are provided, wherein the device comprises column driver circuitry for generating analogue pixel drive signals, the column driver circuitry further comprising means for generating at least one reference drive voltage, and wherein the device further comprises timing means for controlling the duration of application of pixel drive signals and of the reference drive voltage to the display pixels.

24. A device as claimed in claim 23, wherein the column driver circuitry comprises means for generating two reference drive voltages of equal magnitude and opposite polarity.

25. The device of claim 23, wherein the timing means varies the duration of at least one pixel drive signal within a field in order to achieve a desired rms and/or mean voltage of the pixel drive signal within that field, whereby an amount of light output by the corresponding pixel is varied responsive to variations in duration of the pixel drive signal.

26. Apparatus comprising:

a first plurality of parallel conductors;

a second plurality of parallel conductors, perpendicular to the first plurality of conductors, a plurality of display pixels arranged at intersections of the first and second conductors;

drive control circuitry adapted to supply signals on the conductors, the signals coordinating to produce at least one drive voltage across at least one selected display pixel;

the signals along at least one of the first plurality of conductors comprising, for at least one field, a signal having a plurality of preset voltage values; each voltage value having a respective duration; the durations being responsive to at least one parameter to achieve a respective desired rms and/or mean voltage per field for the signal along the at least one of the first plurality of conductors;

the signals along at least one of the second plurality of conductors comprising, for the at least one field, at least one selection pulse; and the drive control circuitry altering the parameter responsive to a desired contrast output of the selected display pixel; whereby rms and/or mean voltage are altered along the at least one of the first plurality of conductors without necessity of altering the preset values.

27. The apparatus of claim 26 wherein the drive control circuitry alters the parameter responsive to temperature.

* * * * *